US005149004A

United States Patent [19]

Sudau et al.

[11] Patent Number: 5,149,004

[45] Date of Patent: Sep. 22, 1992

[54] METHOD FOR COILING STRIP IN REELING INSTALLATIONS

[75] Inventors: Peter Sudau, Hilchenbach; Dieter Rosenthal, Niederfischbach, both of Fed. Rep. of Germany

[73] Assignee: SMS Schloemann-Siemag Aktiengesellschaft, Dusseldorf, Fed. Rep. of Germany

[21] Appl. No.: 823,049

[22] Filed: Jan. 16, 1992

Related U.S. Application Data

[63] Continuation of Ser. No. 502,292, Mar. 30, 1990, abandoned.

[30] Foreign Application Priority Data

Apr. 5, 1989 [DE] Fed. Rep. of Germany ..... 3910991

[51] Int. Cl.[5] ..... B65H 18/26; B21C 47/02

[52] U.S. Cl. ..... 242/57; 242/78.1

[58] Field of Search ..... 242/57, 67.1 R, 67.2, 242/72 R, 72.1, 78.1, 78.3, 63

[56] References Cited

U.S. PATENT DOCUMENTS

| | | | |
|---|---|---|---|
| 3,061,224 | 10/1962 | Herr | 242/72.1 |
| 3,081,958 | 3/1963 | Kegg | 242/57 |
| 3,519,213 | 7/1970 | Hofmann et al. | 242/57 |
| 3,645,120 | 2/1972 | Lind et al. | 242/78.1 X |
| 3,913,367 | 10/1975 | Galletti | 242/78.1 X |
| 4,063,440 | 12/1977 | Brashear | 242/78.1 X |
| 4,343,440 | 8/1982 | Engl | 242/67.2 X |

FOREIGN PATENT DOCUMENTS

| | | | |
|---|---|---|---|
| 2633408 | 10/1977 | Fed. Rep. of Germany | 242/67.1 R |
| 2726855 | 5/1979 | Fed. Rep. of Germany | 242/57 |
| 2939894 | 4/1980 | Fed. Rep. of Germany | 242/78.1 |
| 3318031 | 11/1984 | Fed. Rep. of Germany . | |
| 52-12266 | 1/1977 | Japan . | |
| 55-68123 | 5/1980 | Japan | 242/78.1 |
| 57-9531 | 1/1982 | Japan | 242/78.1 |
| 58-22241 | 2/1983 | Japan | 242/67.1 R |
| 58-58931 | 4/1983 | Japan | 242/78.1 |
| 60-96323 | 5/1985 | Japan | 242/78.1 |
| 61-248868 | 11/1986 | Japan | 242/57 |
| 410848 | 5/1974 | U.S.S.R. . | |
| 2084116 | 4/1982 | United Kingdom | 242/67.1 R |

*Primary Examiner*—Daniel P. Stodol
*Assistant Examiner*—John P. Darling
*Attorney, Agent, or Firm*—Anderson Kill Olick

[57] ABSTRACT

A method for controlling the positions of displaceable pressure rollers during the start-up of coiling strips in reeling installations. The method includes raising pressure rollers from a mandrel of the reeling installation before the strip beginning enters and before the next winding is placed. After the strip beginning has passed each pressure roller, the mandrel is moved into a position of operation. The gap between the pressure rollers in operating position and the mandrel is adjusted to at least n times the strip thickness, wherein n is the number of windings of the strip at each pressure roller. A slip-free contact of the strip on the mandrel is effected by spreading segments of the mandrel. Thus, the pressure rollers are moved as closely as possible to the mandrel while not exerting any pressure forces on the mandrel or only the last pressure roller in strip travel direction presses the strip against the mandrel and the remaining pressure rollers place the strip as closely as possible to the mandrel without exerting any pressure forces on the strip and the mandrel.

12 Claims, 1 Drawing Sheet

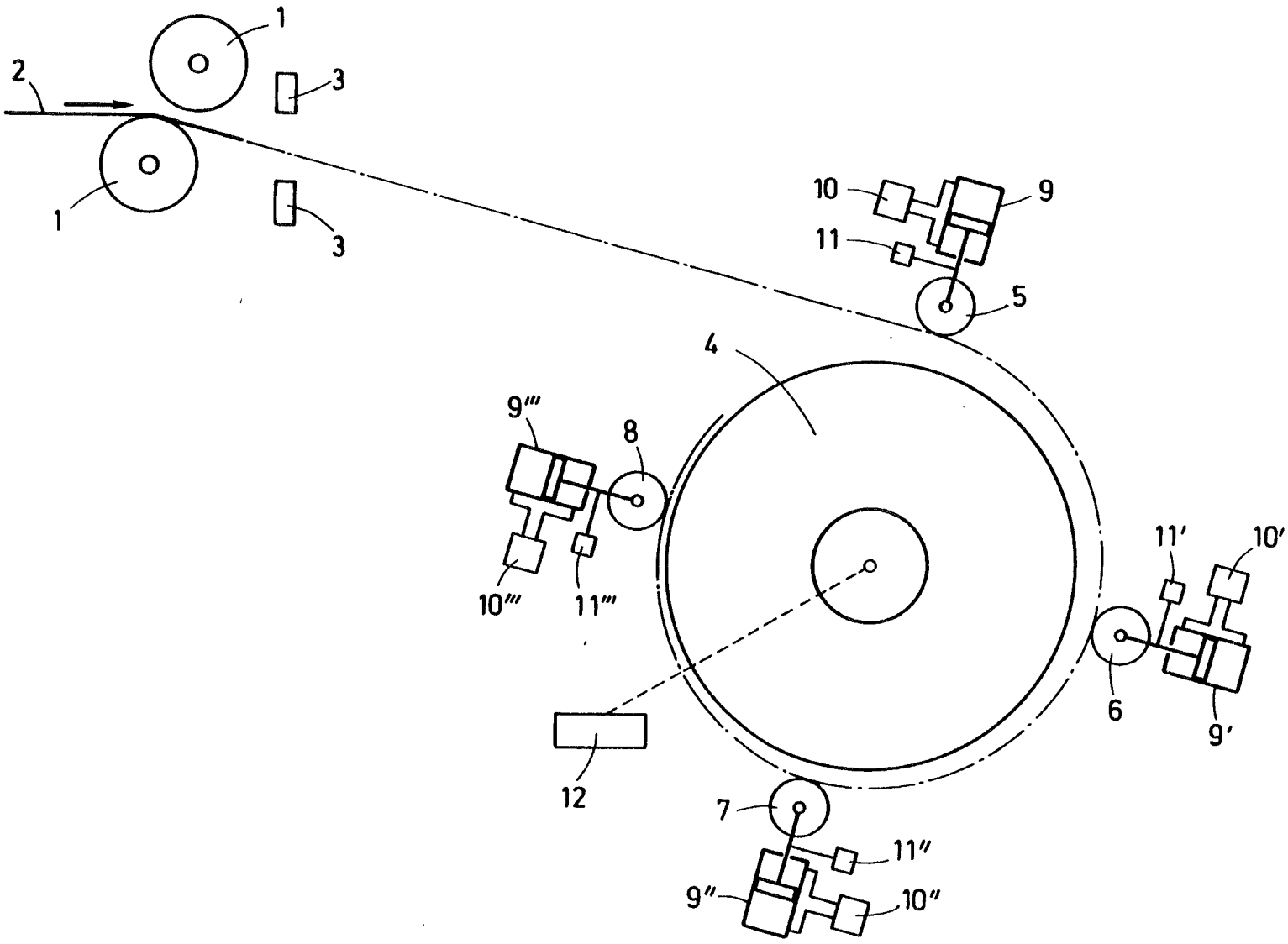
1
1
2
3
3
4
5
6
7
8
9
9'
9''
9'''
10
10'
10''
10'''
11
11'
11''
11'''
12

METHOD FOR COILING STRIP IN REELING INSTALLATIONS

This is a continuation of application Ser. No. 07/502,292, filed Mar. 30, 1990, now abandoned.

BACKGROUND OF THE INVENTION

1. Field of the Invention controlling displaceable pressure rollers during the start-up of coiling of strips in reeling installations, wherein the pressure rollers are displaceable by means of pressure medium-operated cylinders. The beginning of the strip of the entering strip is detected and followed during the travel of the strip around the mandrel and the position of the strip beginning is utilized for positioning the pressure rollers. Before the strip beginning enters and before the next coil is placed, the pressure rollers are raised to such an extent that the gap formed between pressure roller and mandrel exceeds the thickness of the strip which has already entered by a dimension which exceeds the strip thickness. After passing of the strip beginning, the pressure roller is again lowered from this position against the mandrel into the position of operation of the pressure roller.

2. Description of the Related Art

A control installation of the above-described type is known from, for example, German patent 33 18 031. In that installation, during coiling of strips onto reels, the strip beginning is pressed against the reel by means of rollers. In order to keep damage to the strip and the pressure rollers as small as possible, and before passing of a step formed by the strip beginning, the pressure rollers are spaced apart by a dimension which is greater than n times the strip thickness, wherein n is the number of layers of the strip already placed on the mandrel in the region of the respective pressure roller. After the step formed by the strip beginning has passed, the respective pressure roller is switched to pressure. This type of control method has become known as a step control.

It has been found that the step control method leads to satisfactory coiling results when strips are coiled which have a thickness which is greater than approximately 6 mm. However, the step control method is not acceptable for coiling thin strips. The pressure rollers when switched to pressure press the thin strip into the indentations formed between the segments of the reel when the mandrel is spread apart, so that the strip receives undesirable markings. As a result, large portions of the strip beginnings become scrap. In addition, a high load acts on the pressure rollers when they are lowered into the indentations between the individual segments, so that substantial wear of the pressure rollers occurs and significant noise is generated. Moreover, the unsteady positions of the pressure rollers on the reel cause the adjusting devices for the pressure rollers to be worn excessively.

SUMMARY OF THE INVENTION

It is, therefore, the primary object of the present invention to improve existing methods for controlling pressure rollers which are displaceable by pressure medium-operated cylinders during coiling of strip in reeling installations, so that the above-described disadvantages do not occur even when strips having a small thickness are coiled.

In accordance with the present invention, the gap between the pressure roller in operating position and the mandrel is adjusted to at least n times the strip thickness, wherein n is the number of windings of the strip coiled onto the mandrel at each pressure roller. Preferably at the beginning of the second layer, a slip-free contact of the strip with the reel is effected by spreading the mandrel. During the spreading movement of the mandrel, the pressure rollers are moved from the mandrel by the distance of the radial movement of the reel segments.

It has been found useful if the gap formed between pressure roller and mandrel decreases in coiling direction from pressure roller to pressure roller. In addition, the desired dimension of the gap formed between each pressure roller and the mandrel is dimensioned such that the pressure rollers are capable of deflecting the entering strip, while not resulting in a radially directed force against the surface of the mandrel.

If the pressure rollers are placed in their position of operation in this manner, it is ensured that the gap between the respective pressure roller and the mandrel is adjusted exactly to the strip thickness or slightly greater than the strip thickness. The pressure rollers which are now only used as guide rollers, move the strip as closely as possible to the mandrel, however, they can no longer press into the indentations between the individual segments. As a result, no markings are formed on the strips. The spreading movement of the mandrel results in a quick and slip-free contact of the strip with the mandrel.

In accordance with another method according to the present invention, the last pressure roller in strip entering direction has a position of operation in which the gap between the pressure roller and the mandrel is slightly less than n times the strip thickness. The second-to-last pressure roller in the strip entering direction has a position of operation in which the gap is greater than or equal to n times the strip thickness. The pressure rollers arranged in front of the two last pressure rollers each have a position of operation in which the gap exceeds n times the strip thickness by an added dimension, wherein the added dimension increases from pressure roller to pressure roller in the direction opposite the strip entering direction. Preferably at the beginning of the second layer, a slip-free contact of the strip with the mandrel is effected by spreading the mandrel. During the spreading movement of the mandrel, the pressure rollers are spaced from the mandrel by the dimension of the radial movement of the reel segments.

The predetermined positions of operation of the pressure rollers described above have the result that only one of the pressure rollers presses the strip with a minimum force against the mandrel and that the remaining pressure rollers when in their position of operation form a funnel-type entry gate which guides and places the strip as closely as possible toward the mandrel.

In accordance with an advantageous feature, before the entry of the strip beginning or before the beginning of the next coil layer, the height of the position of the pressure roller decreases from pressure roller to pressure roller in entry direction of the strip. This forms a funnel-type entry gate already at the beginning of the entry of the strip, so that the strip is guided in an optimum manner toward the mandrel. This gate becomes even narrower when the pressure rollers are placed in their position of operation.

In accordance with another advantageous feature, the pressure rollers are moved into the raised position by a position control and are moved into the position of operation by a force control. The force control circuit is preferably controlled proportionally. In addition, the set force value corresponds to the strip guiding force and, when the predetermined strip guiding force is reached, the actual value of the position control circuit is set as the base value to which is added the next jump into the raised position to form the new total set value.

As a result, even when multiple foldings of the strip occur after the predetermined strip guiding force has been reached, no additional pressing forces act on the strip and, thus, on the mandrel. As soon as the set force value and the actual force value are equal, the actual value of the position control circuit is set as the new force value for each newly adjusted gap between the pressure roller and mandrel, wherein each subsequent jump is added to the base value, so that, even in the case of multiple foldings, the height in the jump of the pressure rollers which follow the pressure roller which has passed the first multiple foldings, can be raised to the predetermined set value which is inherent to the strip.

In order to prevent damage to the strip and to the pressure rollers and to the adjusting devices for the pressure rollers, it is possible to adjust at least the last pressure roller in the entry direction of the strip by a position control and by a force control which is subordinated to the position control. This makes it possible to realize minimum pressure forces which prevent damage to the strip and to the reel installations.

In accordance with another useful feature, the position of the strip beginning is continuously determined by means of a strip tracking system. The strip tracking system is started by an acceleration indicator and/or a pressure gauge at the exit driver of the pitch line in front of the reel or by a switch which detects the strip beginning without contact. The strip tracking system is synchronized by the incoming strip through acceleration indicators and/or pressure measuring devices arranged at the pressure rollers. The position of the strip beginning is computed from the circumferential speed of the driver roller, the strip thickness and the geometric dimensions of the reel installation.

In accordance with another useful feature, the mandrel is spread by a position control, wherein the dimension of the radial distance of the pressure rollers from the mandrel is taken from the position control circuit.

As a result, the exact dimensions for the radial spacings of the pressure rollers can be determined, so that the pressure rollers do not exert any forces or exert exactly the predetermined forces on the mandrel even during the spreading movement of the mandrel. In addition, it is possible to coil coils having an exactly predeterminable inner diameter.

When errors occur in the strip tracking system or when there are multiple foldings of the strip, it is recommended to space all pressure rollers from the mandrel in dependence on the amount by which the forces effected by the strip and measured at the pressure rollers by the pressure measuring devices exceed the predetermined threshold values. In addition, when the threshold value or threshold values are further exceeded, the pressure rollers are completely pivoted away from the mandrel. As a result, damage to the reeling installation and to the strip can be reduced to a minimum.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

The single FIGURE of the drawing is a schematic view of the installation used for carrying out the method according to the present invention.

DETAILED DESCRIPTION OF THE PREFERRED EMBODIMENT

The FIGURE of the drawing shows a driver 1 in the open position. A guide means, not shown, for the strip 2 is arranged following the driver 1 in strip travel direction. Also arranged following the driver 1 in strip travel direction is a switch 3 which operates without contact, for example, a light barrier or a nozzle baffle plate system. Pressure rollers 5, 6, 7 and 8 are arranged around a mandrel 4. The pressure rollers 5, 6, 7, 8 are movable by means of hydraulic cylinders 9, 9', 9'', 9''' into a raised position of operation. The hydraulic cylinders 9, 9', 9'', 9''' include pressure measuring devices 10, 10', 10'', 10''' and position indicators 11, 11', 11'', 11'''.

As shown in the drawing, the mandrel 4 includes mandrel segments 4', 4'', 4''', 4''''. As indicated by double arrows, the segments are radially movable relative to the reel shaft 13. The mandrel is spread by moving the segments radially outwardly.

The operation of the control according to the present invention is described in the following. All dimensions which are necessary for the computation of the strip beginning and are inherent to the reeling system are stored in the computer of a strip tracking system, not shown. Only the strip thickness of the strip 2 to be coiled is entered in the computer.

As soon as the strip 2 has passed the switch 3, the driver 1 is closed and the computer and, thus, the continuous computation of the position of the strip beginning, are started. The pressure rollers 5, 6, 7, 8 are adjusted to the position illustrated in the drawing in which the gap between each pressure roller 5, 6, 7, 8 and the mandrel 4 is greater than the strip thickness by a dimension which is stored in the computer, wherein the gap decreases in strip entry or travel direction from pressure roller to pressure roller and, in the case of pressure roller 5, for example, is 2.5 times the strip thickness. The strip speed can be derived from the circumferential speed of the driver rollers.

When the strip beginning makes contact with the deflection shell, not shown, of roller 5, the force impulse determined by the pressure measuring device 10 is utilized for the synchronization of the computed and the actual position of the strip beginning. The deflection shell bends the strip beginning toward the pressure roll 6. The strip beginning is then similarly bent towards roller 7 and roller 8. Once the strip beginning has passed the pressure roller 8 in accordance with the position computed in the strip tracking system, the pressure roller 5 is moved by means of the cylinder 9 and by a position control into its position of operation for the second layer of the coil. Simultaneously, the pressure rollers 6, 7, 8 are moved into their positions of operation by a force control. The actual force values increase in strip entry or travel direction from pressure roller to pressure roller, however, the actual force values are never adjusted to such a level that contact pressure forces act on the mandrel 4.

As soon as the step formed by the strip beginning has passed the pressure roller 5, the pressure roller 5 is moved into its position of operation. This position of operation exceeds the dimension of twice the thickness of the strip 2 by the added dimension stored in the computer.

After the step has passed the pressure roller 5, the mandrel 4 is spread by means of a position control circuit 12.

When the second winding of the coil is coiled, the pressure rollers 6, 7 and 8 are similarly raised and then returned into their position of operation. The position of operation and the raised position of the pressure rollers 5, 6, 7, 8 are corrected by the dimension by which the mandrel is spread during the second winding.

If errors occur in the computation of the strip beginning during the start-up of the coiling which have the result that the strip beginning or a step formed by the strip beginning makes contact with a pressure roller 5, 6, 7, 8 which is not moved into its raised position, a peak force is measured in one of the pressure measuring devices 10, 10', 10'', 10'''. If this peak force exceeds predetermined threshold values, the pressure rollers are moved away from the mandrel in dependence upon the level of the threshold value which was exceeded. When a peak force is again measured at the next pressure roller in coiling direction, the pressure rollers 5, 6, 7, 8 are completely pivoted away from the mandrel.

While a specific embodiment of the invention has been shown and described in detail to illustrate the application of the inventive principles, it will be understood that the invention may be embodied otherwise without departing from such principles.

We claim:

1. In a method for controlling displaceable pressure rollers during the start-up of coiling a strip in a reeling installation, the pressure rollers being displaceable by means of pressure medium-operated cylinders, the reeling installation including a mandrel with spreadable segments, the method including detecting the beginning of the strip entering the reeling installation, following the strip beginning during the travel of the strip around the mandrel, utilizing the position of the strip beginning for positioning the pressure rollers, raising the pressure rollers before the strip beginning enters between the pressure rollers and the mandrel and before the next winding is placed to such an extent that a gap formed between the respective pressure roller ad the mandrel exceeds the thickness of the strip which has already entered by a dimension which exceeds the strip thickness, and lowering each pressure roller after the strip beginning has passed from the raised position toward the mandrel into a position of operation, the improvement comprising adjusting the gap between each pressure roller in the operating position and the mandrel to at least n times the strip thickness, wherein n is the number of windings of the strip coiled onto the mandrel at each pressure roller, and the respective gaps between each pressure roller and the mandrel are decreasing in the coiling direction from pressure roller to pressure roller with the pressure rollers being in their position of operation, effecting a slip-free contact of the strip with the mandrel at the beginning of the second winding of the strip by spreading the segments of the mandrel, and moving the pressure rollers during the spreading movement of the segments away from the mandrel by a distance which corresponds to the radial movement of the segments.

2. The method according to claim 1, comprising dimensioning a set value of the gap formed between the pressure rollers and the mandrel such that the pressure rollers deflect the entering strip while no radially directed forces act against the mandrel surface.

3. In a method for controlling displaceable pressure rollers during the start-up of coiling strips in reeling installations, the pressure rollers being displaceable by means of pressure medium-operated cylinders, the reeling installations including a mandrel with spreadable segments, the method including detecting the beginning of the strip entering the reeling installations, following the strip beginning during the travel of the strip around the mandrel, utilizing the position of the strip beginning for positioning the pressure rollers, raising the pressure rollers before the strip beginning enters between the pressure roller and the mandrel and before the next coil is placed to such an extend that a gap formed between each pressure roller and mandrel exceeds the thickness of the strip which has already entered by a dimension which exceeds the strip thickness, and lowering each pressure roller after the strip beginning has passed from the raised position toward the mandrel into a position of operation, the improvement comprising providing a position of operation for the last pressure roller in strip travel direction in which the gap between the last pressure roller and the mandrel is slightly less than n times the strip thickness wherein n is the number of windings of the strip coiled onto the mandrel at each pressure roller providing a position of operation for the second-to-last pressure roller in strip travel direction in which the gap between the second-to-last pressure roller and the mandrel is at least equal to n times the strip thickness, providing positions of operation for the pressure rollers arranged upstream of the last two pressure rollers in which the gap between the pressure rollers and the mandrel exceeds the at least equal to n times the strip thickness of the second-to-last roller by an added dimension, wherein the added dimension decreases from pressure roller to pressure roller in operative direction of the strip travel direction, and effecting a slip-free contact of the strip with the mandrel at the beginning of the second layer by spreading the segments of the mandrel, wherein the pressure rollers are moved away from the mandrel during the spreading movement of the segments by a distance which corresponds to the radial movement of the segments.

4. The method according to claims 1 or 3, wherein, prior to the entry of the strip beginning or prior to the beginning of the next strip layer, the level of the positions of the pressure rollers is decreased from pressure roller to pressure roller in travel direction of the strip.

5. The method according to claims 1 or 3, comprising positioning the pressure rollers prior to the entry of the strip beginning or prior to the beginning of the next coil winding at an equal distance from the mandrel.

6. The method according to claims 1 or 3, comprising moving the pressure rollers into the raised position by means of a position control circuit and into the position of operation by a force control circuit.

7. The method according to claim 6, wherein a set force value corresponds to the strip guiding force, comprising, when the predetermined strip guiding force is reached, setting the actual value of the position control circuit as a base value to which is added the next jump into the raised position as a new total set value.

8. The method according to claims 1 or 3, comprising moving the pressure rollers in position of operation by a position control, and adjusting at least the last pressure roller in strip travel direction by a force control.

9. The method according to claims 1 or 3, comprising continuously determining the position of the strip beginning by means of a strip tracking system, starting the strip tracking system by means of an acceleration indicator or a pressure gauge at an exit driver of a pitch line in front of the mandrel or by means of a switch which detects the strip beginning without contact, synchronizing the strip tracking system by means of the entering strip through additional acceleration indicators and pressure measuring devices, and computing the position of the strip beginning from the circumferential speed of the driver roller, the strip thickness and the geometric dimensions of the reel installation.

10. The method according to claim 9, comprising spacing all pressure rollers from the mandrel in dependence on the amount by which the forces are effected by the strip and measured at the pressure rollers by means of the pressure measuring devices exceed predetermined threshold values, and completely pivoting the pressure rollers away from the mandrel when the threshold value or values are exceeded further.

11. The method according to claims 1 or 3, wherein the segments of the mandrel are spread by means of a position control circuit, and wherein the dimension for the radial spacing of the pressure rollers from the mandrel is taken from the position control circuit.

12. The method according to claims 1 or 3, comprising continuously determining the position of the strip beginning by means of a strip tracking system, starting the strip tracking system by means of an acceleration indicator or a pressure gauge at an exit driver of a pitch line in front of the mandrel or by means of a switch which detects the strip beginning without contact, synchronizing the strip tracking system by means of the entering strip through additional acceleration indicators or pressure measuring devices, and computing the position of the strip beginning from the circumferential speed of the driver roller, the strip thickness and the geometric dimensions of the reel installation.

* * * * *